US008459863B2

(12) United States Patent
Hoefken et al.

(10) Patent No.: US 8,459,863 B2
(45) Date of Patent: Jun. 11, 2013

(54) AGITATOR DEVICE FOR CIRCULATING A LIQUID IN A CLEARING BASIN

(75) Inventors: Marcus Hoefken, Erlangen (DE); Thomas Hagspiel, Erlangen (DE); Torsten Frey, Nuremberg (DE)

(73) Assignee: Invent Umwelt-und Verfahrenstechnik AG, Erlanger (DE)

( * ) Notice: Subject to any disclaimer, the term of this patent is extended or adjusted under 35 U.S.C. 154(b) by 917 days.

(21) Appl. No.: 12/449,668

(22) PCT Filed: Mar. 18, 2008

(86) PCT No.: PCT/EP2008/002124

§ 371 (c)(1),
(2), (4) Date: Oct. 7, 2009

(87) PCT Pub. No.: WO2008/113547

PCT Pub. Date: Sep. 25, 2008

(65) Prior Publication Data

US 2011/0003646 A1 Jan. 6, 2011

(30) Foreign Application Priority Data

Mar. 19, 2007 (DE) ..... 10 2007 013 630

(51) Int. Cl.
*B01F 7/24* (2006.01)
*B01F 15/00* (2006.01)

(52) U.S. Cl.
CPC ..... *B01F 7/24* (2013.01); *B01F 15/00448* (2013.01)
USPC ..... 366/331

(58) Field of Classification Search
USPC ..... 277/408, 563; 366/331, 101
See application file for complete search history.

(56) References Cited

U.S. PATENT DOCUMENTS

| | | | | |
|---|---|---|---|---|
| 3,176,996 | A * | 4/1965 | Barnett | 277/318 |
| 3,735,435 | A * | 5/1973 | Mikulicic et al. | 441/5 |
| 3,901,177 | A * | 8/1975 | Scott | 440/5 |
| 4,065,232 | A * | 12/1977 | Stratienko | 417/368 |
| 4,168,070 | A * | 9/1979 | Tsuchihashi et al. | 277/317 |
| 4,210,534 | A | 7/1980 | Molvar | |
| 5,474,304 | A * | 12/1995 | Daiber et al. | 277/500 |
| 5,798,572 | A * | 8/1998 | Lehoczky | 290/54 |
| 7,185,955 | B2 * | 3/2007 | Dombroski | 301/108.1 |

FOREIGN PATENT DOCUMENTS

| | | |
|---|---|---|
| DE | 36 13 625 A1 | 11/1987 |
| DE | 39 25 053 A1 | 1/1991 |
| DE | 10 2005 017 823 | 10/2006 |
| EP | 0 144 850 | 6/1985 |
| GB | 861705 | 2/1961 |
| WO | WO 97/21055 | 6/1997 |

* cited by examiner

*Primary Examiner* — Tony G Soohoo
(74) *Attorney, Agent, or Firm* — Manabu Kanesaka

(57) ABSTRACT

The invention relates to a drive device for the immersed operation below a surface of a liquid (F), particularly for the immersed operation in a clearing basin, having a drive shaft (5) guided out of a housing, wherein the drive shaft (5) is guided through an axial face seal (12, 13) received in a sealing chamber (10) for sealing the housing against penetrating liquid. In order to improve the service life of the seal, the invention provides that a line (22) is connected to the sealing chamber (10) for receiving an oil supply and is guided to above the surface of the liquid (F).

14 Claims, 4 Drawing Sheets

AGITATOR DEVICE FOR CIRCULATING A LIQUID IN A CLEARING BASIN

Figure 1:
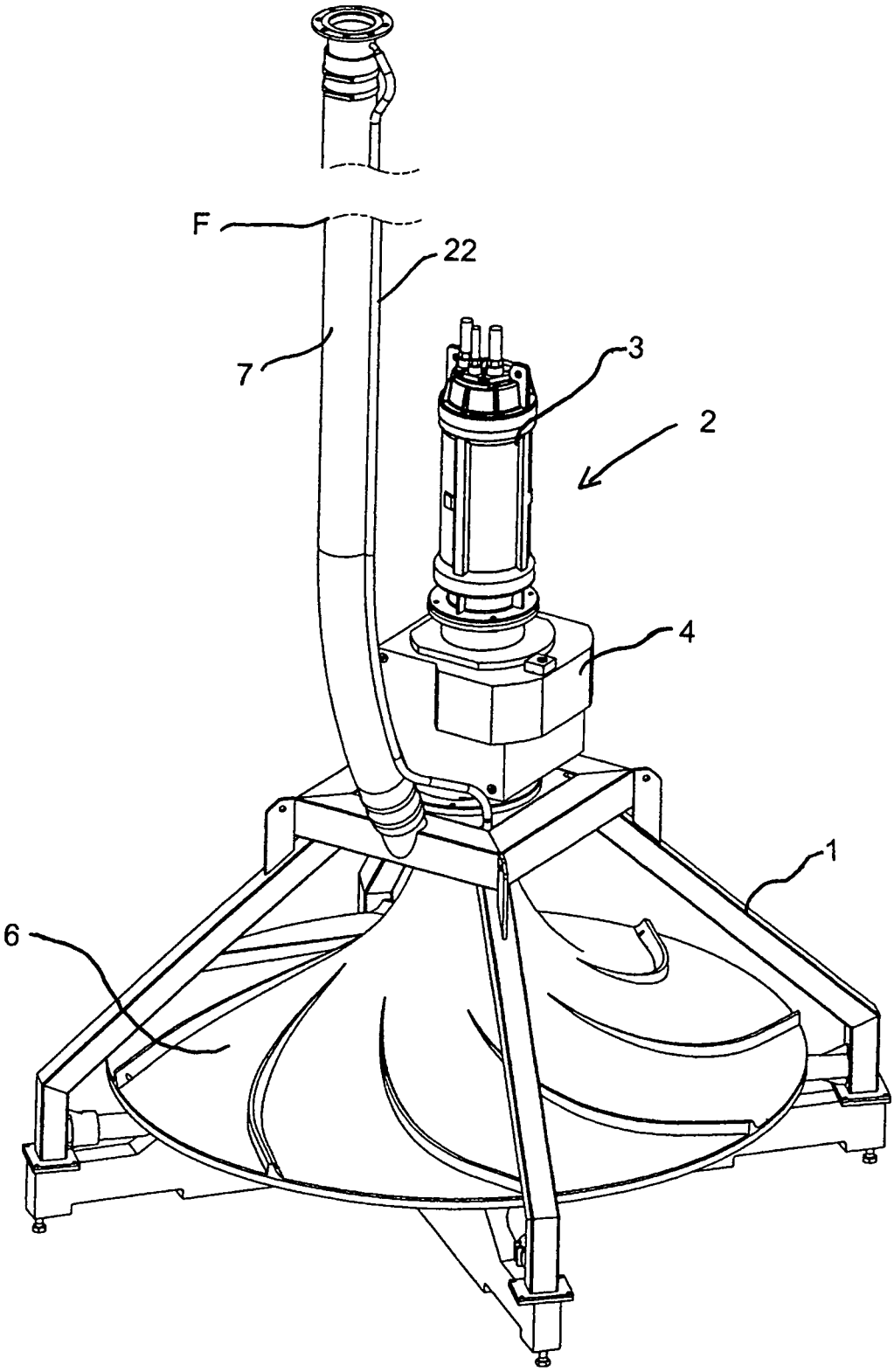

The invention relates to a drive device for immersed operation below a surface of a liquid, in particular for the immersed operation in a clearing basin.

In accordance with the prior art, agitator devices are used to circulate waste water received in a clearing basin. In this connection, one distinguishes between vertical agitator devices wherein, for example, a hyperboloid-like designed agitator body is rotated via a vertical drive shaft. In this connection, an electric motor that drives the drive shaft can either be attached above or below the surface of the liquid. Moreover, so-called horizontal agitator devices are known wherein an electric motor which is usually attached under the surface of the liquid rotates a propeller.

With agitator devices with a drive device attached below the surface of the liquid, it is necessary to seal the drive shaft which is guided out of a housing of the drive device in such a manner that no liquid can penetrate the housing. For this purpose, the drive shaft is usually guided through a sealing chamber on whose inlet a shaft seal is provided and on whose outlet which is facing the liquid an slide-ring seal is provided. An oil supply is usually received in the sealing chamber to lubricate the slide-ring seal.

In actual practice, the slide-ring seal must be maintained at regular intervals and, if necessary, must be replaced. This involves a significant amount of work since, in this case, the agitator device must usually be lifted out of the clearing basin and must be taken apart.

An object of the invention is to eliminate the disadvantages in accordance with prior art. In particular, a drive device is to be specified with which an immersed operation with an improved service life is possible. In accordance with another goal of the invention, maintenance of the drive device is to be as simple as possible and, in particular, damage in the area of the seal is to be easy to recognize.

This object is resolved by the features of aspects 1 and 11. Useful embodiments of the invention result from the features of aspects 2 to 10 as well as 12 and 13.

According to the invention, it is provided that a line for receiving an oil supply is connected to the sealing chamber and is guided above the surface of the liquid.—With this, the service life of a drive device operated below a surface of a liquid can be significantly increased in a surprisingly simple way. By providing the sealing chamber with an oil supply that reaches up to above the liquid, it can be easily ensured that the sealing chamber is completely filled with oil at all times. The oil level in the sealing chamber can be easily checked. An impermissibly rapid decrease in the oil supply in the line indicates a defect in the slide-ring seal. Thus a repair of the slide-ring seal can be limited to the cases in which it is actually damaged. A further essential advantage of the invention is that a hydrostatic pressure is exerted on the oil received in the sealing chamber due to the oil supply reaching to above the surface of the liquid. With this, the oil in the sealing chamber is under a greater pressure than the liquid in the vicinity of the drive shaft. With this, an undesired penetration of liquid into the area of the slide-ring seal can be prevented. It can be ensured that the axial seal face is supplied with oil at all times.

According to an advantageous embodiment, the line is designed as transparent at least in a section located above the surface of the liquid. This makes a visual check simple and quick. With this, it can be immediately determined whether there is still enough oil in the line.

According to a further advantageous embodiment of the invention, the line is connected with a source of pressure for producing an overpressure exceeding the liquid pressure surrounding the sealing chamber. In this connection, the source of pressure is preferably provided above the surface of the liquid. That makes repairs and maintenance easier. The source of pressure is usefully a source of compressed air which is connected to the oil supply.

The source of pressure can also be a compressed air line. Particularly for sewerage treatment plants, such compressed air lines are positioned in the area of the agitator devices to aerate the clearing basin. Such a compressed air line is usually guided down to the bottom of the clearing basin and subjected to a pressure which enables air to exit in the area of the bottom of the clearing basin against the active pressure of the liquid. In contrast, the oil-filled sealing chamber of the drive device is immersed less deep in the liquid so that the pressure of the liquid in the vicinity of the sealing chamber is less than the air pressure in the compressed air line. Thus a connection of the line to the compressed air line provides a simple way to produce an overpressure in the sealing chamber which prevents an undesired penetration of liquid into the sealing chamber at all times. The line is advantageously guided over an essential part of its length essentially vertically, i.e., at an incline of more than 40°, along the compressed air line. Particularly in such a vertical section, it is connected with the compressed air line. In this connection, a connection location of the line on the compressed air line is usefully located at a height of 10 cm to 200 cm, preferably approximately 50 cm to 100 cm, above a level of the liquid.

According to a further embodiment of the invention, it is provided that the line is guided along the compressed air line at least in sections to the sealing chamber. The compressed air line is usually much more stable in design than the line. Damage or undesired tensile forces can be avoided by fixing the line to the compressed air line.

The line can be guided at least in sections along a cable providing the electric motor with current. Also in this case, an improved protection of the line against damages is achieved.

In the sense of this invention, the term "drive device" is to be understood as a general term. In this connection, it can be an electric motor. In this case, the drive shaft is part of the electric motor. The drive device can also be combined with a gear unit. In this case, the drive shaft is part of a gear unit driven by the electric motor.

The sealing chamber is usefully sealed with a shaft seal surrounding the drive shaft on a second side facing the electric motor or the gear unit. In this connection, this can be a conventional shaft seal, for example, a rotary shaft seal or similar, with which oil under overpressure is effectively prevented from leaving the sealing chamber.

In particular in the aforementioned case, the sealing chamber, the slide-ring seal and the shaft seal can be part of a sealing device designed as a mounting unit. Replacing such a sealing device is easy and quick. Separate disassembly of the seals received inside which is time-consuming and expensive is avoided.

According to further provisions of the invention, an immersible agitator is provided on which an inventive drive device is attached to a frame and wherein the drive shaft is connected to an agitator body. The agitator body can be a propeller or a hyperboloid agitator body. The drive shaft can be positioned horizontally or vertically with respect to a liquid surface. The frame can be part of a ventilation device and be connected with a compressed air line. In other words, the frame can be at least in sections designed as hollow so that compressed air can be guided down to the vicinity of the bottom of a clearing basin, for example.

Figure 2:
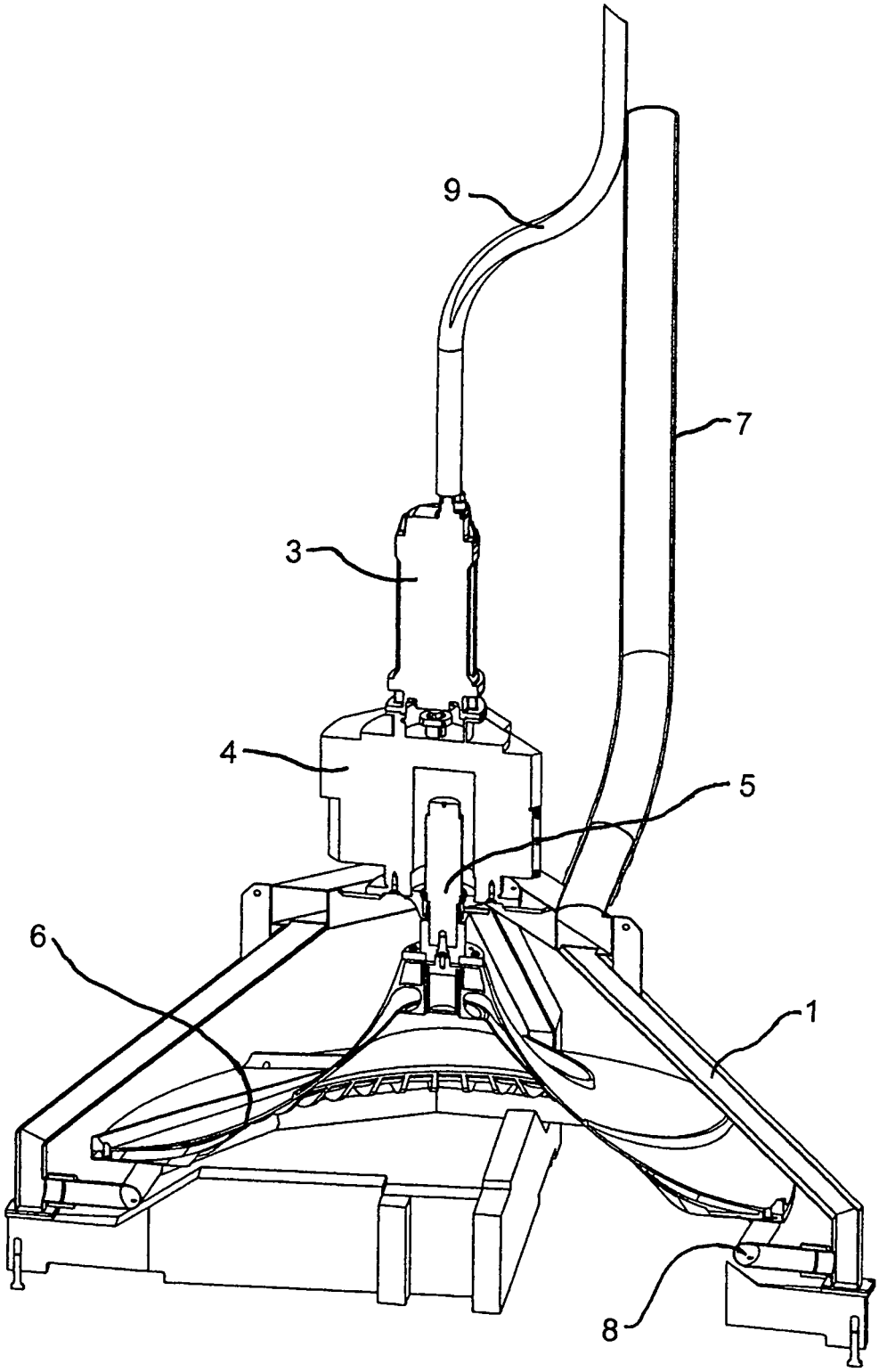
Figure 3:
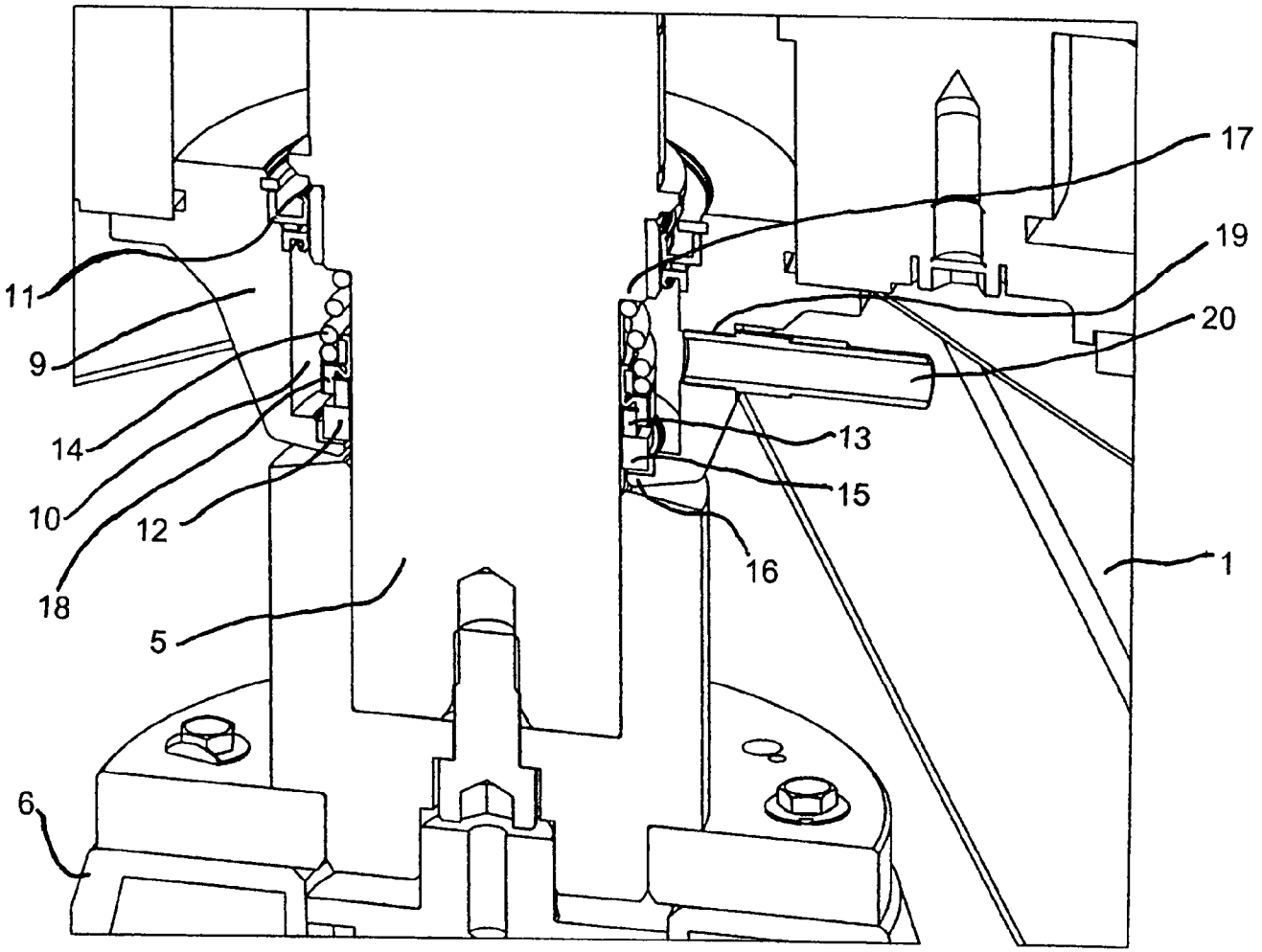

The invention will now be described in more detail using an exemplary embodiment based on an agitator device. It is shown:

FIG. 1A presentation in perspective of an immersible agitator,

FIG. 2 a partial sectional view in perspective as per FIG. 1,

FIG. 3 a partial view with sealing chamber as per FIG. 2 and

Figure 4:
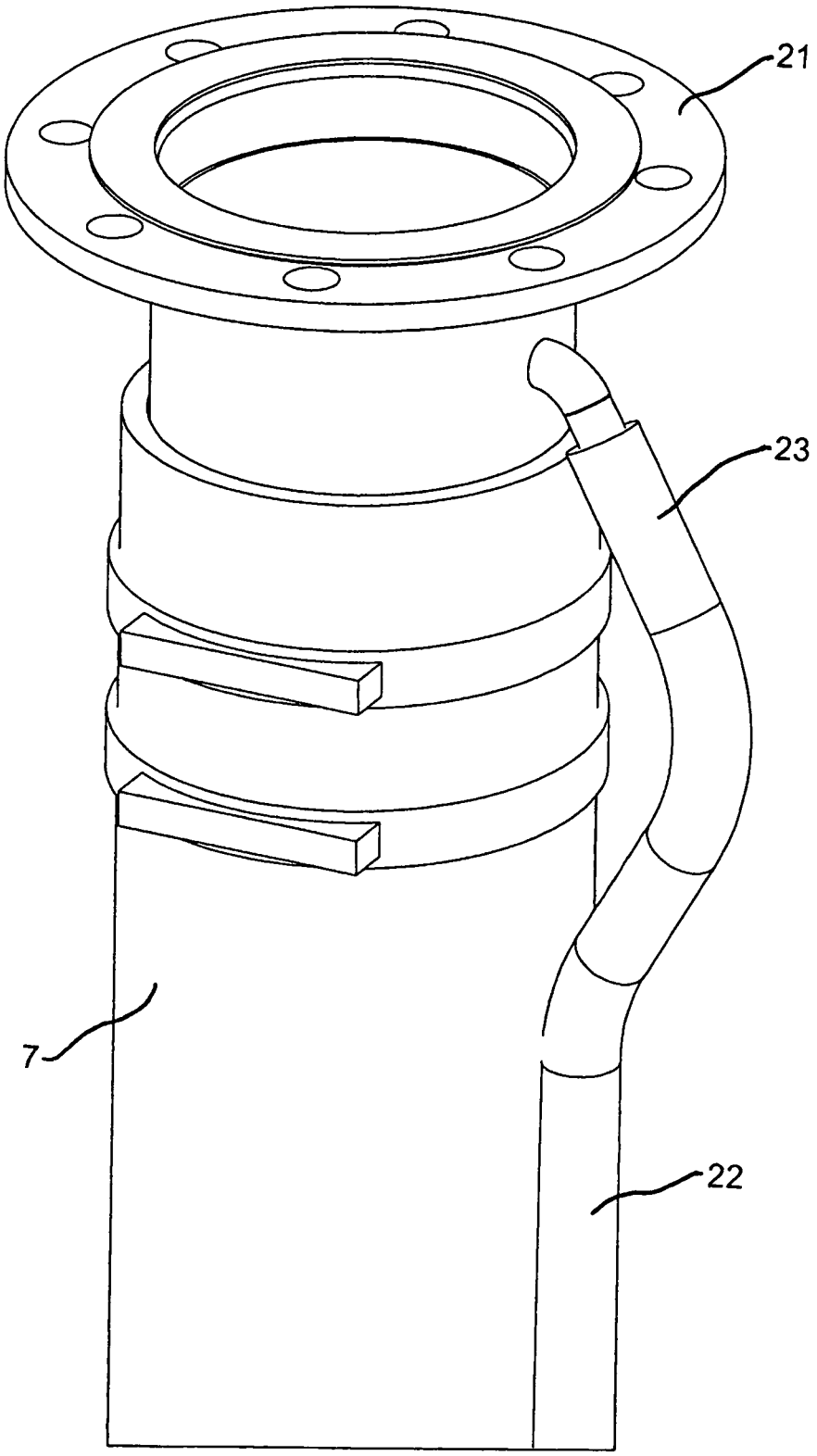

FIG. 4 a view in perspective of an end section of the compressed air hose.

FIGS. 1 and 2 show an immersible agitator which can be operated under a surface of a liquid F in a clearing basin, for example. A drive device 2 is fixed to a frame 1. The drive device 2 comprises an electric motor 3 which is connected drive-wise with a gear unit 4. A drive shaft 5 on which an agitator element 6, here a hyperboloid agitator, is attached extends out of a housing surrounding the drive device 2, here a housing section surrounding the gear unit.

A compressed air hose 7 is attached to the frame 1 made of hollow pipes, in particular square pipes. Located below the agitator element 6 is a ring line 8 which is also connected to the frame 1 which ring line is provided with ventilation openings (not shown here). Air can thus be moved through the compressed air hose 7 through the frame 1 to the ring line 8 and from there through the ventilation openings to an area below the agitator element 6. The compressed air hose 7 can also be directly connected to the ring line 8 or to another suitable aerating element. In other words, the frame 1 does not have to be part of a ventilation device.

A cable 9 connected to the electric motor 3 is guided in sections along the compressed air hose 7 and is connected to the compressed air hose 7 in this section.

FIG. 3 shows a detailed view of a sealing device 9 designed as a mounting unit which sealing device surrounds a sealing chamber 10. The drive shaft 5 is guided through a shaft seal 11 being received on the entry side of the sealing device 9 and through an slide-ring seal 12 being received on the exit side of the sealing device 9. A sliding ring 13 is pressed against a counter sliding ring 15 by a spring 14. The counter sliding ring 15 is supported on a surrounding housing section 16 which protrudes radially to the inside. The spring 14 is supported against a radially surrounding shoulder 17 of the drive shaft 5. A sealing collar 18 made of an elastic material extends from the sliding ring 13 to the vicinity of the shoulder 17. The sealing chamber 10 has a breakthrough 19 to which a first connection element 20 of a line (not shown here) is attached.

FIG. 4 shows a view in perspective of an end of the compressed air hose 7 located above the surface of the liquid'F, which is provided with a flange 21 for connecting to a compressed air line (not shown here). A line 22 connected to the sealing chamber 10 using the first connection element 20 is connected to the compressed air hose 7 in the area of the flange 21 using a second connection element 23. The line 22 is usefully made of a transparent hose so that an oil inside can be seen from the outside. As is particularly shown in FIG. 1, the line 22 is guided along the compressed air hose 7 and is fixed to it.

The function of the drive device is as follows:

The sealing chamber 10 being sealed by the slide-ring seal 12 and by the shaft seal 11 is filled with an oil, preferably a biologically degradable oil. The line 22 leading away from the sealing chamber 10 is also filled with oil. The oil received the line 22 represents an oil supply. The amount of oil supply received in the line 22 can be readily checked visually from the outside when the line is designed as transparent. For this purpose, the section of the line 22 located above the surface of the liquid F can be provided with a marking.

The oil supply and thus also the oil in the sealing chamber 10 is subjected to an overpressure by connecting the line 22 to the pressure hose 7 using the second connection element 23. The overpressure is greater than a pressure of a liquid acting on the slide-ring seal 12. Due to this, a small amount of oil continuously escapes through the slide-ring seal 12 in the direction of the surrounding liquid. With this, it is ensured at all times that no liquid, in particular no dirty liquid, can penetrate the slide-ring seal 12 and cause wear to same.

The inventive drive device was described before based on an immersible agitator. Naturally, the suggested inventive drive device can also be used for other purposes.

A connection of the line 22 to the compressed air hose 7 was described for simplicity's sake as a source of pressure in the present exemplary embodiment. Naturally, it is also possible to use other sources of pressure to produce an overpressure in the pressure chamber 10. For example, the overpressure can also be produced via a compressor or similar.

In the present exemplary embodiment, a volume given by the line 22 was described as the oil supply. Naturally, it is also possible to connect the line 22 to a supply tank or to provide a supply tank in the line 22.

The mounting unit described advantageously as a sealing device 9 in the present exemplary embodiment can also be part of a gear unit housing or a motor housing. In other words, it does not have to be designed as a mounting unit.

LIST OF REFERENCE SIGNS

1 Frame
2 Drive device
3 Electric motor
4 Gear unit
5 Drive shaft
6 Agitator element
7 Compressed air hose
8 Ring line
9 Sealing device
10 Sealing chamber
11 Shaft seal
12 Slide-ring seal
13 Sliding ring
14 Spring
15 Counter sliding ring
16 Housing section
17 Shoulder
18 Collar
19 Breakthrough
20 First connection element
21 Flange
22 Line
23 Second connection element
F Surface of a liquid

The invention claimed is:

1. An agitator device for circulating a liquid in a clearing basin, comprising:

a drive device for immersed operation below a surface of the liquid;

a housing to house the drive device;

a sealing chamber arranged inside the housing;

a drive shaft connected to the drive device and guided out of the housing;

a slide-ring seal received in the sealing chamber for sealing around the drive shaft to prevent the liquid from entering the sealing chamber;

a line for receiving an oil supply connected to the sealing chamber and guided to above the surface of the liquid so that the oil received in the sealing chamber is under a greater pressure than the liquid in a vicinity of the drive shaft for preventing a penetration of the liquid around the slide-ring seal, wherein the line is formed transparent at least in a section located above the surface of the liquid to visually check an oil level in the sealing chamber from outside the clearing basin.

2. An agitator device as defined in claim 1, further comprising a source of pressure connected to the line for producing an overpressure exceeding a liquid pressure surrounding the sealing chamber.

3. An agitator device as defined in claim 2, wherein the source of pressure is a compressed air line.

4. An agitator device as defined in claim 3, wherein the line is guided at least in sections along the compressed air line to the sealing chamber.

5. An agitator device as defined in claim 1, wherein the drive device is an electric motor, and a cable is guided at least in sections along the line for providing the electric motor with current.

6. An agitator device as defined in claim 1, wherein the drive device is an electric motor including the drive shaft.

7. An agitator device as defined in claim 1, wherein the drive device comprises an electric motor, and a gear unit driven by the electric motor and including the drive shaft.

8. An agitator device as defined in claim 1, wherein the sealing chamber comprises a shaft seal surrounding the drive shaft to seal a side towards the drive device.

9. An agitator device as defined in claim 8, further comprising a sealing device defining a mounting device including the sealing chamber, the slide-ring seal and the shaft seal.

10. An agitator device as defined in claim 1, further comprising a frame wherein the drive device is attached thereto, and an agitator body connected to the drive shaft.

11. An agitator device as defined in claim 10, wherein the agitator body is a propeller or a hyperboloid agitator body.

12. An agitator device as defined in claim 10, further comprising a ventilation device connected to a compressed air line and including the frame to guide the compressed air to a vicinity of a bottom of the clearing basin.

13. An agitator device as defined in claim 1, wherein the slide-ring seal is arranged to constantly release a small amount of oil therethrough to prevent the liquid in the clearing basin from entering through the slide-ring seal.

14. An agitator device as defined in claim 1, further comprising an urging device disposed inside the housing to urge the slide ring seal outwardly, wherein the oil supplied from the line applies pressure radially inwardly and outwardly on the slide-ring seal so that the penetration of the liquid from the slide-ring seal is prevented.

* * * * *